US005485194A

United States Patent [19]

Tateoka

[11] Patent Number: 5,485,194

[45] Date of Patent: Jan. 16, 1996

[54] OPTICAL SCANNING APPARATUS

[75] Inventor: Masamichi Tateoka, Yokohama, Japan

[73] Assignee: Canon Kabushiki Kaisha, Tokyo, Japan

[21] Appl. No.: 407,399

[22] Filed: Mar. 17, 1995

Related U.S. Application Data

[63] Continuation of Ser. No. 979,058, Nov. 19, 1992, abandoned.

[30] Foreign Application Priority Data

Nov. 20, 1991 [JP] Japan ..... 3-332534

[51] Int. Cl.[6] ..... B41J 2/435

[52] U.S. Cl. ..... 347/232; 347/242

[58] Field of Search ..... 347/232, 241, 347/243, 242; 359/200, 204, 206, 217

[56] References Cited

U.S. PATENT DOCUMENTS

| | | | |
|---|---|---|---|
| 4,571,021 | 2/1986 | Minoura et al. | 350/6.8 |
| 4,634,232 | 1/1987 | Tateoka | 359/394 |
| 5,121,137 | 6/1992 | Taki et al. | 347/232 |
| 5,179,462 | 1/1993 | Kageyama et al. | 346/108 |
| 5,181,137 | 1/1993 | Koide | 346/108 |
| 5,305,022 | 4/1994 | Ota et al. | 346/108 |

FOREIGN PATENT DOCUMENTS

| | | |
|---|---|---|
| 59-15219 | 1/1984 | Japan . |
| 1-187992 | 7/1989 | Japan . |
| 3-150174 | 6/1991 | Japan . |

*Primary Examiner*—Mark J. Reinhart

*Attorney, Agent, or Firm*—Fitzpatrick, Cella, Harper & Scinto

[57] ABSTRACT

An optical scanning apparatus comprises a light source provided with a plurality of light emitting portions different in emission wavelength on a single stem, a deflector for deflecting a plurality of beams from the light source an optical system for converging the plurality of beams deflected by the deflector, and a wavelength separation device for separating the plurality of beams from the optical system from each other. The optical scanning apparatus may be applicable to a laser beam printer by combining it with a photosensitive member to which the plurality of beams separated by the wavelength separation device are guided.

40 Claims, 4 Drawing Sheets

OPTICAL SCANNING APPARATUS

This application is a continuation of application Ser. No. 07/979,058 filed Nov. 19, 1992, now abandoned.

BACKGROUND OF THE INVENTION

1. Field of the Invention

The present invention relates to an optical scanning apparatus. Specifically, the invention relates to an optical scanning apparatus in which a plurality of light beams different in wavelength are guided through a set of scanning means (scanning optical system) onto one or more planes to be scanned, on a recording medium (for example photosensitive drum) to conduct simultaneous optical scanning.

2. Related Background Art

Among recent digital copiers is a so-called dichromatic color copying laser beam printer of multiple exposure and multiple development in which at least two different regions on a plane to be scanned are simultaneously exposed to laser beams (light beams) and in which the respectively exposed regions are developed by respective developing devices different in color.

In the dichromatic copying laser beam printer, the two regions on the plane to be scanned are simultaneously optically scanned by a device structured to have two light beams and two sets of scanning means (scanning optical systems).

FIG. 1A and FIG. 1B are schematic drawings of main part to show a conventional optical scanning apparatus to perform the simultaneous optical scanning of two regions on a surface to be scanned using the scanning optical systems. FIG. 1A is a main part side view to show a part of the optical scanning apparatus as seen along a direction perpendicular to a rotation shaft of a light deflector, and FIG. 1B a main part plan view as seen along a direction of the rotation shaft of the light deflector.

In FIG. 1B one light source means 51*a* comprising a semiconductor laser emits a light beam toward a collimating lens 52*a*, and the collimating lens 52*a* collimates the light beam into a parallel light beam. The collimated light beam passes through a cylindrical lens 53*a* having a predetermined refractive power in a direction normal to a sheet plane of FIG. 1B, that is, in a sub scanning direction thereby to form a linear image near a reflection plane (deflection plane) 54*a* of a light deflector 54 comprising a polygon mirror.

Another light source means 51*b* emits a light beam toward a collimating lens 53*b*, and the collimating lens 52*b* collimates the light beam into a parallel light beam. The collimated light beam passes through a cylindrical lens 53*b* having a predetermined refractive power in the sub scanning direction thereby to form a linear image via a reflection mirror 55 near a reflection plane 54*b* of a light deflector 54.

In FIG. 1B, an optical path from the light source means 51*a* to the reflection plane 54*a* of the light deflector 54 is shifted in the direction normal to the sheet plane of FIG. 1B with respect to an optical path from the light source means 51*b* via the reflection mirror 55 to the reflection plane 54*b*, whereby they are different in height.

The respective light beams are reflection-deflected by the light deflector 54 having the upper and lower two level reflection planes (deflection planes) 54*a* and 54*b*. The light deflector 54 is rotated by a motor 56 of drive means at a certain speed in a direction of arrow A.

The respective light beams reflection-deflected by the respective reflection planes 54*a*, 54*b* thereafter pass through an image forming optical system 57 having the f-θ characteristics, which comprises two lenses 57*a* and 57*b*. Each of the two lenses 57*a* and 57*b* is comprised of upper and lower two levels adhered to each other. The light beam reflection-deflected by the reflection plane 54*a* passes through the upper level of the image forming optical system 57 in FIG. 1A, and is imaged (converged) via turn mirrors 60, 61 at an exposure position P2 on a photosensitive drum 62.

On the other hand, the light beam reflection-deflected by the reflection plane 54*b* passes through the lower level of the image forming optical system 57 as shown in FIG. 1A, and is imaged (converged) via turn mirrors 58, 59 at an exposure position P1 on the photosensitive drum 62.

Optical scanning is carried out at the respective exposure positions P1, P2 in a direction normal to the sheet plane of FIG. 1A (in the main scanning direction) by rotating the light deflector 54 in the direction of arrow A. The photosensitive drum 62 is rotated in the sub scanning direction as shown by an arrow B with the exposure in the main scanning direction, whereby the photosensitive drum 62 is sequentially exposed at the exposure positions P1, P2. Electrostatic latent images on the photosensitive drum 62 are developed by developing devices (not shown) corresponding to the respective light beams.

The conventional optical scanning apparatus employs two sets of scanning means (scanning optical systems) as described for simultaneous optical scanning of two regions on a plane to be scanned using the two light beams. Such an arrangement requires a large space for installation of the scanning means, resulting in increase in size of the entire apparatus and in the number of parts whereby to increase a production cost thereof.

In addition, the polygon mirror as the light deflector is structured to have the upper and lower two levels of reflection plane as shown in FIG. 1A, or, the reflection plane of the polygon mirror must be enlarged in the sub scanning direction. Thus, an occupying space of the polygon mirror increases in the apparatus, and loads on a motor also increase to obtain a certain rotation speed, which are also problematic in the conventional apparatus.

Further, in practice, a gap between the light beams is restricted in respect that the two light beams are to be reflected by the respective reflection planes 54*a*, 54*b*, so that it becomes very difficult to arrange the turn mirrors in position.

SUMMARY OF THE INVENTION

It is an object of the present invention to provide an optical scanning apparatus which utilizes light source means having a plurality of light emitting portions provided on a single stem to emit a plurality of light beams different in wavelength in the same direction and wavelength separation means for separating the plurality of light beams different in wavelength into respective light beams, whereby the plurality of light beams are guided by a set of scanning means (scanning optical system) to positions different from each other on a plane to be scanned or onto planes to be scanned corresponding to the respective light beams to conduct simultaneous optical scanning thereon, and which may be made simple and compact while decreasing the production cost of the entire apparatus.

An optical scanning apparatus according to the present invention is characterized in that light source means comprises a plurality of light emitting portions provided on a single stem; the light source means emits a plurality of light beams different in wavelength; the plurality of light beams advance in a single optical path and is guided through optical means to a light deflector; the plurality of light beams reflection-deflected by the light deflector is converged by an image forming optical system; the plurality of light beams are separated by wavelength separation means; the separated light beams are guided to a plurality of regions on a single plane to be scanned or to a plurality of planes to be scanned corresponding to the respective light beams; and simultaneous optical scanning is carried out with the plurality of light beams on the plane(s) to be scanned.

DETAILED DESCRIPTION OF THE PREFERRED EMBODIMENTS

Figure 1A:
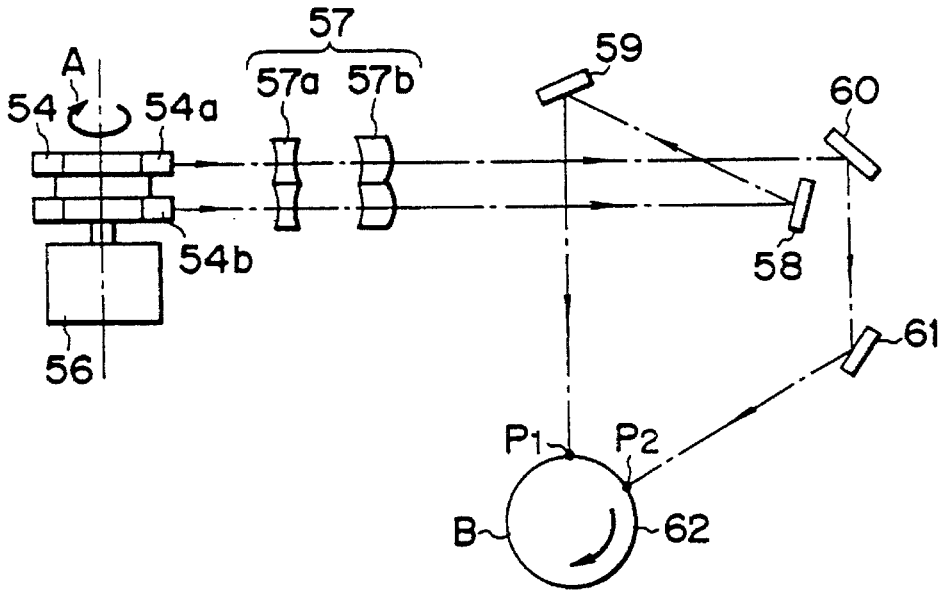
FIG. 1A PRIOR ART
FIG. 1A and FIG. 1B are schematic drawings to show a main part of a conventional optical scanning apparatus.
Figure 1B:
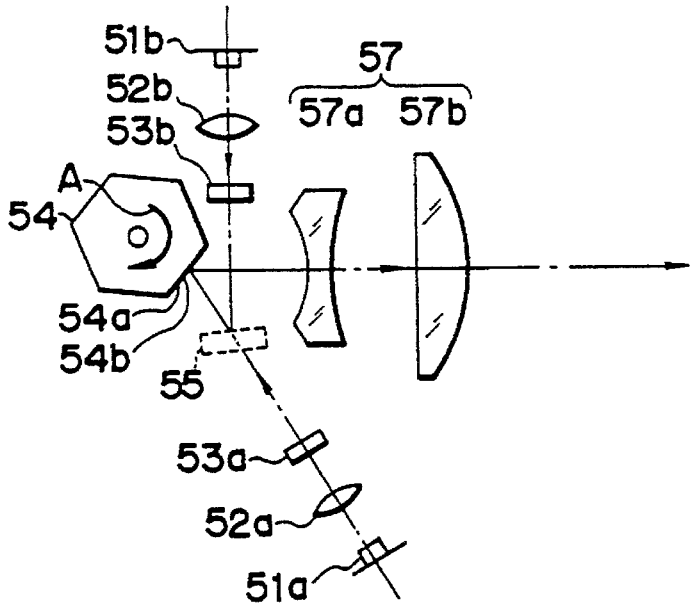
FIG. 1B PRIOR ART
Figure 2A:
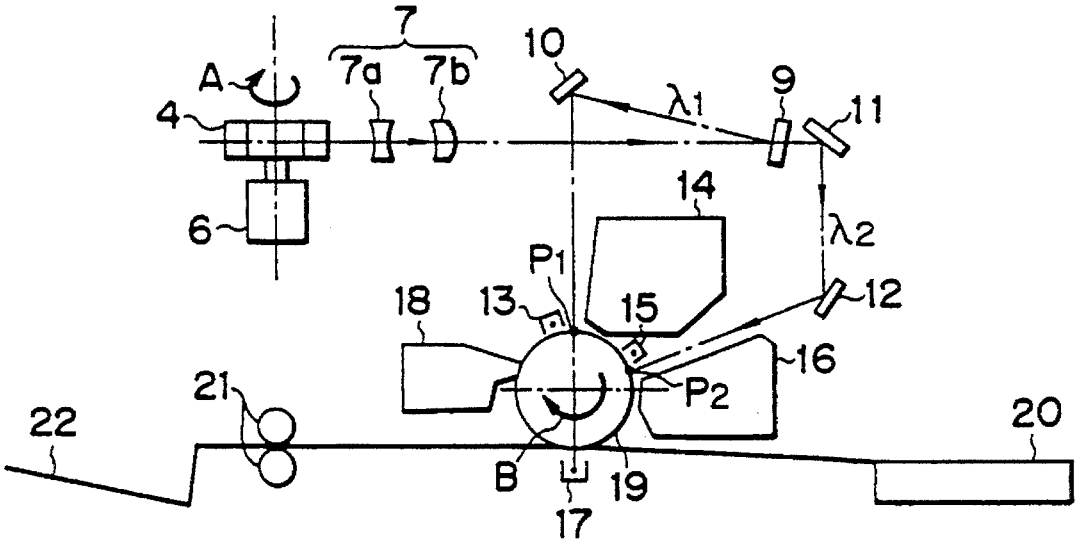
FIG. 2A and FIG. 2B are schematic drawings to show a main part of a first embodiment of a laser beam printer using an optical scanning apparatus according to the present invention.
Figure 2B:
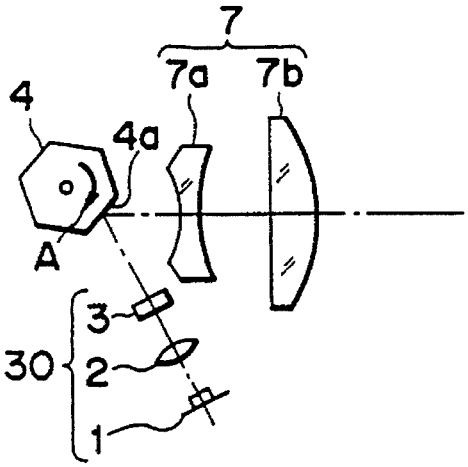
Figure 3:
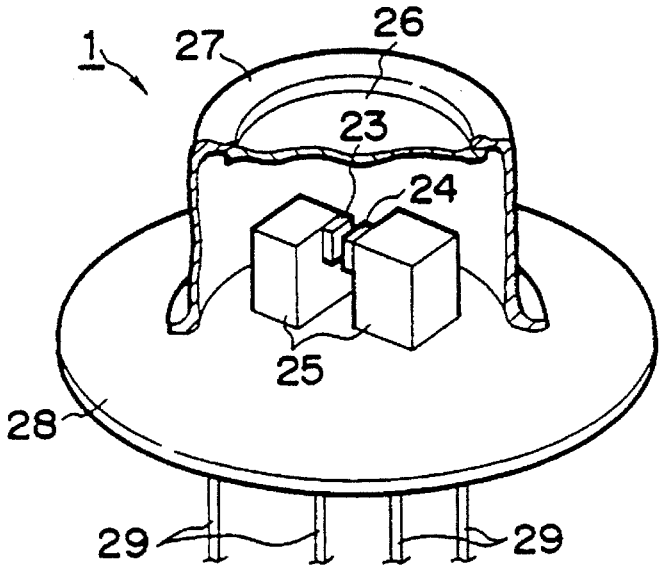
FIG. 3 is a perspective view to show a main part of light source means as shown in FIGS. 2A and 2B.

FIG. 2A and FIG. 2B are schematic drawings to show a main part of a first embodiment of a laser beam printer using an optical scanning apparatus according to the present invention. FIG. 2A is a side view of the main part as seen along a direction perpendicular to a rotation shaft of a light deflector, and FIG. 2B is a plan view of the main part as seen along a direction of the rotation shaft of the light deflector. FIG. 3 is a perspective view to show a main part of light source means as shown in FIG. 2B.

In the drawings, reference numeral 1 designates light source means of semiconductor laser, in which two light emitting portions (semiconductor laser chips) 23, 24 are juxtaposed in a direction normal to a main scanning section, that is, in a sub scanning direction (a direction normal to the sheet plane of FIG. 2B). The light emitting portions 23, 24 of the light source means 1 are enclosed in a single cap 27, and are respectively adhered to heat sinks (radiators) 25 independent of each other. The heat sinks 25 are attached to a single stem 28. This arrangement allows the light source means 1 to be sized as substantially equal to a semiconductor laser (light source means) used in a conventional optical scanning apparatus which performs optical scanning with one beam.

The heat sinks (radiators) 25 radiate heat generated in the cap 27. Numeral 26 denotes a window glass, and 28 a stem to hold outgoing lines 29 from electrodes of the semiconductor lasers.

In the present embodiment the two light emitting portions 23, 24 emit respective light beams different in wavelength based on respective image information. A wavelength $\lambda_1$ of one light beam is for example 670 nm, and a wavelength $\lambda_2$ of the other light beam is for example 780 nm.

Numeral 2 designates a collimating lens, which collimates the two light beams different in wavelength based on the respective image information as emitted from the light source means 1, into substantially parallel light beams. Numeral 3 denotes a cylindrical lens, which has a predetermined refractive power only in the sub scanning section. The collimating lens 2 and the cylindrical lens 3 constitute optical means 30 to guide the light beams to a light deflector 4.

The light deflector 4 comprises a polygon mirror, which is rotated by a motor 6 of drive means at a predetermined speed in a direction of arrow A. Numeral 7 represents an image forming optical system having the f-θ characteristics, which is composed of two lenses 7*a* and 7*b*. The image forming optical system 7 images the respective light beams reflection-deflected by the light deflector 4 at two exposure positions P1, P2 different from each other on a surface of a photosensitive drum 19, that is, a plane to be scanned.

Figure 4:
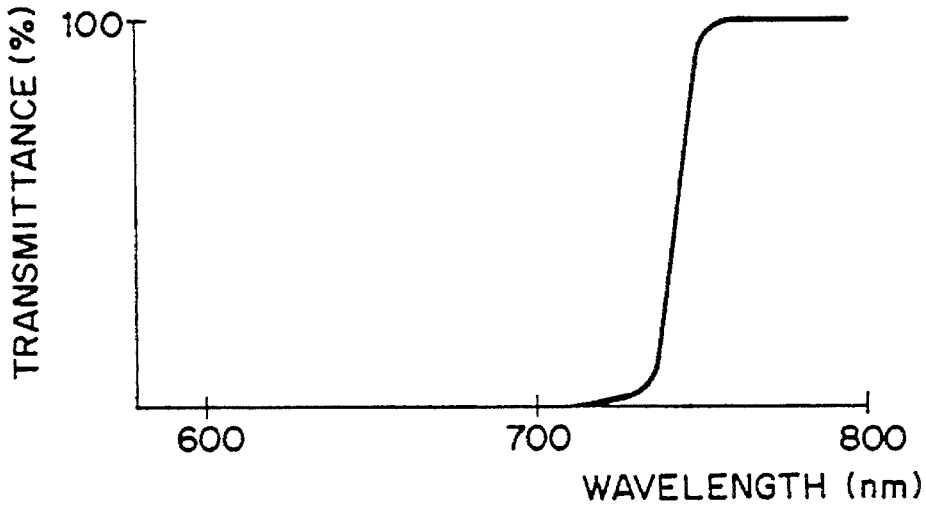
FIG. 4 is an explanatory drawing to show a spectral distribution of wavelength separation means as shown in FIGS. 2A and 2B.

Numeral 9 is wavelength separation means, which comprises an optical member on which a multi-layer film is vapor-deposited, specifically a dichroic mirror which has a spectral distribution as shown in FIG. 4. The wavelength separation means 9 reflects the light beam of the wavelength $\lambda_1$ (670 nm) and transmits the light beam of the wavelength $\lambda_2$ (780 nm). Numeral 10 is a turn mirror, which guides the light beam of the wavelength $\lambda_1$ reflected by the dichroic mirror 9 to the exposure position P1 on the surface of the photosensitive drum 19, which is the recording medium. Numerals 11 and 12 denote turn mirrors, respectively, which guide the light beam of the wavelength $\lambda_2$ passed through the dichroic mirror 9 to the exposure position P2 on the photosensitive drum 19. The photosensitive drum 19 rotates at a predetermined speed in the direction of arrow B.

Numeral 13 is a first charging device, which uniformly charges a surface of the photosensitive drum 19. Numeral 14 is a first developing device, which has for example black toner attached to a latent image on the surface of the photosensitive drum 19 to develop (visualize) it. Numeral 15 is a second charging device, which uniformly charges the surface of the photosensitive drum 19. Numeral 16 is a second developing device, which has for example red toner attached to a latent image on the surface of the photosensitive drum 19 to develop (visualize) it.

Numeral 17 denotes a transfer charging device, which electrically transfers a toner image formed on the surface of the photosensitive drum 19 onto a transfer medium (copy sheet). Numeral 18 represents a drum cleaner, which removes toner remaining on the surface of the photosensitive drum 19. Numeral 20 is a sheet discharge cassette, and 21 a fixing device to fix the toner image transferred onto the copy sheet to obtain a permanent image. Numeral 22 denotes a sheet discharge tray.

In the present embodiment as structured as above, the two light beams of wavelengths $\lambda_1$, $\lambda_2$ independently optically modulated by image signals different in color information from the light source means 1 are collimated by the collimating lens 2 into substantially parallel light beams, and the collimated light beams enters the cylindrical lens 3. The cylindrical lens 3 has the parallel light beams go out as they are in the main scanning section, but has them converge in the sub scanning section to form a substantially linear image on the reflection plane (deflection plane) 4*a* of the light deflector 4.

After that, the respective light beams reflection-deflected by the reflection plane 4*a* of the light deflector 4 pass through the image forming optical system 7 then to enter the dichroic mirror 9. The light beam of the wavelength $\lambda_1$ is reflected by the dichroic mirror 9 and is converged via the turn mirror 10 at the first exposure position P1 on the surface of the photosensitive drum 19 to form a light beam of predetermined spot, whereby the first image information is sequentially formed on the surface of the photosensitive drum 19.

On the other hand, the light beam of the wavelength $\lambda_2$ passes through the dichroic mirror 9, and is converged via the two turn mirrors 11, 12 at the second exposure position P2 on the surface of the photosensitive drum 19 to form a light beam of predetermined spot, whereby the second image information is sequentially formed on the surface of the photosensitive drum 19.

The photosensitive drum 19 is uniformly charged by the first charger 13 and is subject to scanning exposure with the light beam of the wavelength $\lambda_1$ of the first image information at the first exposure position P1 to form an electrostatic latent image corresponding to the first image information. The latent image is developed by the first developing device 14, for example, by a black toner developing device to obtain a black image.

The photosensitive drum 19 carrying the black image is again uniformly charged by the second charging device 15, and is subject to scanning exposure with the light beam of the wavelength $\lambda_2$ corresponding to the second image information at the second exposure position P2 to form an electrostatic latent image corresponding to the second image information. The latent image is developed by the second developing device 16, for example by a red toner developing device to obtain a red image. By the above operation a dichromatic image of the black image with the red image is formed on the surface of the photosensitive drum 19.

The dichromatic image is transferred onto a copy sheet fed from the sheet supply cassette 20 between the photosensitive drum 19 and the transfer charging device 17 so as to be separated from the photosensitive drum 19. The copy sheet with the dichromatic image is transferred to the fixing device 21 to fix the image thereon, and is then discharged onto the sheet discharge tray 22.

Accordingly, the respective elements are arranged as described in the present embodiment, so that a set of scanning means (scanning optical system) may guide two light beams to two different portions on the surface of the photosensitive drum 19 to conduct simultaneous optical scanning thereon, whereby the entire apparatus can be made compact and simple while decreased in production cost.

Also, since the height of the light deflector (polygon mirror) need not be increased in the present embodiment, the loads on the motor may be reduced so as to readily achieve a higher rotation speed, whereby a high speed scanning can be made.

In the present embodiment, three or more light emitting portions may be provided as the light source means 1 to radiate three or more light beams different in wavelength, and a plurality of dichroic mirrors may be used as the wavelength separation means to guide the light beams to a plurality of regions on the photosensitive drum surface to conduct the simultaneous optical scanning. In such a case developing devices and charging devices should be provided corresponding to the number of the light beams.

Figure 5A:
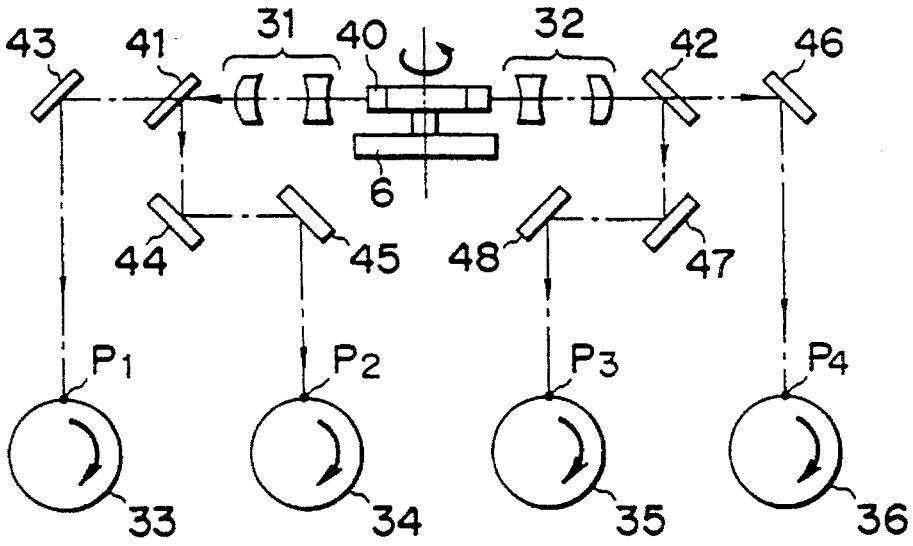
FIG. 5A and FIG. 5B are schematic drawings to show a main part of a second embodiment of a laser beam printer using an optical scanning apparatus according to the present invention.
Figure 5B:
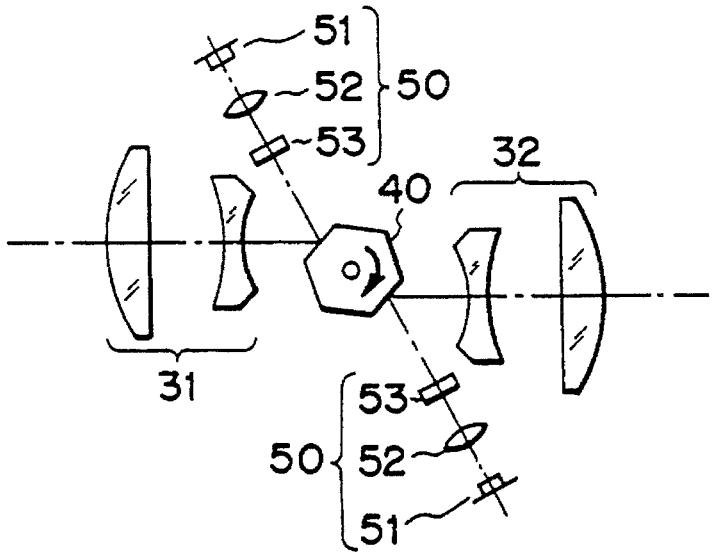

FIG. 5A and FIG. 5B are schematic drawings to show a main part of a second embodiment of a laser beam printer using an optical scanning apparatus according to the present embodiment.

The second embodiment is an example of apparatus in which two sets of light source means as described in FIG. 3 are used to emit four light beams to conduct simultaneous optical scanning on four photosensitive drums. In FIGS. 5A and 5B, the same elements as those as shown in FIGS. 2A and 2B are given the same numerals. FIG. 5A is a side view of the main part as seen along a direction perpendicular to a rotation axis of a light deflector, and FIG. 5B is a plan view of the main part as seen along the direction of the rotation axis of the light deflector.

In FIGS. 5A and 5B, reference numerals 41, 42 designate wavelength separation means, each of which is disposed in an optical path between an image forming optical system and photosensitive drums. Each of the wavelength separation means comprises a dichroic mirror having the spectral distribution as shown in FIG. 4 similarly as in the first embodiment.

Numerals 31, 32 denote image forming optical systems respectively having the f-θ characteristics, 43, 44, 45, 46, 47, and 48 are turn mirrors, respectively, 33, 34, 35, and 36 photosensitive drums, respectively, and P1, P2, P3, and P4 exposure positions, respectively.

In the present embodiment light source means 51 same as that as shown in FIG. 3 is disposed on either side of the reflection plane of the light deflector 40 comprising a polygon mirror.

Specifically, the two light beams different in wavelength emitted from the respective light source means 51 are guided to enter reflection facets of the light deflector 40 opposing to each other on either side thereof. The respective light beams reflection-deflected by the respective reflection facets of the light deflector 40 pass through the respective image forming optical systems 31, 32, and are then reflected or transmitted to be separated by the respective dichroic mirrors 41, 42.

After that, a beam of separated one of the two beams is guided via the turn mirror 43 (46) and the other beam thereof via the turn mirrors 44, 45 (47, 48), and they are converged at exposure positions P1, P2, (P3, P4) on respectively corresponding photosensitive drums 33, 34 (35, 36) to form predetermined spots of the light beams. The light deflector 40 and the photosensitive drums 33 to 36 rotate in the directions of arrows in the drawings to independently form respective latent images on respective surfaces of the photosensitive drums 33 to 36.

In the second embodiment as described, multiple images may be obtained in a simple structure without increasing the size of the entire apparatus by using a plurality of light source means and wavelength separation means as shown in FIG. 3, as explained.

In the present embodiment, the collimating lens 52 and the cylindrical lens 53 constituting the optical means 50 may be arranged to be a laminated lens by gluing them to each other so that chromatic aberration correction may be effected for a light beam having wavelengths between $\lambda_1$ (670 nm) and $\lambda_2$ (780 nm), whereby a finer spot of light beam may be formed.

Although the plural light beams are selected as the one light beam at the wavelength of $\lambda_1$=670 nm and as the other light beam at the wavelength of $\lambda_2$=780 nm in the respective embodiments, there is no specific restrictions on the wavelengths of the light beams if they can be separated by the wavelength separation means.

Also, although the dichroic mirror is used as the wavelength separation means in the respective embodiments, any optical member can be employed in the same manner as in the aforementioned embodiments if it can separate a plurality of light beams different in wavelength as described.

Attainable according to the present invention as described is an optical scanning apparatus which utilizes light source means in which a plurality of light emitting portions are provided on a single stem to radiate a plurality of light beams different in wavelength and wavelength separation means for separating the plural light beams into individual light beams, whereby a set of scanning means (scanning optical system) can conduct simultaneous optical scanning on one or more planes to be scanned with the plural light beams, and which may be made compact and simple in easy arrangement.

What is claimed is:

1. An optical scanning apparatus comprising:

light source means provided with a plurality of light emitting portions different in emission wavelength on a single stem;

a deflector for deflecting a plurality of beams from said light source means;

an optical system for converging said plurality of beams deflected by said deflector; and wavelength separation means for separating said plurality of beams from said optical system from each other.

2. An optical scanning apparatus according to claim 1, wherein said light source means is so arranged that the plurality of light emitting portions different in emission wavelength are disposed in a single cap.

3. An optical scanning apparatus according to claim 1, wherein said light source means is so arranged that the plurality of light emitting portions different in emission wavelength are juxtaposed in a direction normal to a main scanning section.

4. An optical scanning apparatus according to claim 1, wherein said wavelength separation means comprises a dichroic mirror.

5. A laser beam printer comprising:

light source means provided with a plurality of light emitting portions different in emission wavelength on a single stem;

a deflector for deflecting a plurality of beams from said light source means;

an optical system for converging said plurality of beams deflected by said deflector;

wavelength separation means for separating said plurality of beams from said optical system from each other; and a photosensitive member to which said plurality of beams separated by said wavelength separation means are guided.

6. A laser beam printer according to claim 5, wherein said light source means is so arranged that the plurality of light emitting portions different in emission wavelength are disposed in a single cap.

7. A laser beam printer according to claim 5, wherein said light source means is so arranged that the plurality of light emitting portions different in emission wavelength are juxtaposed in a direction normal to a main scanning section.

8. A laser beam printer according to claim 5, wherein said wavelength separation means comprises a dichroic mirror.

9. An optical scanning apparatus comprising:

light source means provided with a plurality of light emitting portions different in emission wavelength on a single stem;

a deflector for deflecting a plurality of beams from said light source means; and wavelength separation means for separating said plurality of beams from said light source means from each other.

10. An optical scanning apparatus according to claim 9, wherein said light source means is so arranged that the plurality of light emitting portions different in emission wavelength are disposed in a single cap.

11. An optical scanning apparatus according to claim 9, wherein said light source means is so arranged that the plurality of light emitting portions different in emission wavelength are juxtaposed in a direction normal to a main scanning section.

12. An optical scanning apparatus according to claim 9, wherein said wavelength separation means comprises a dichroic mirror.

13. A laser beam printer comprising:

light source means provided with a plurality of light emitting portions different in emission wavelength on a single stem;

a deflector for deflecting a plurality of beams from said light source means;

wavelength separation means for separating said plurality of beams from said light source means from each other; and a photosensitive member to which said plurality of beams separated by said wavelength separation means is guided.

14. A laser beam printer according to claim 13, wherein said light source means is so arranged that the plurality of light emitting portions different in emission wavelength are disposed in a single cap.

15. A laser beam printer according to claim 13, wherein said light source means is so arranged that the plurality of light emitting portions different in emission wavelength are juxtaposed in a direction normal to a main scanning section.

16. A laser beam printer according to claim 13, wherein said wavelength separation means comprises a dichroic mirror.

17. An optical scanning apparatus according to claim 1, wherein said plurality of light emitting portions different in emission wavelength are independently provided on a heat sink which is provided on the single stem.

18. A laser beam printer according to claim 5, wherein said plurality of light emitting portions different in emission wavelength are independently provided on a heat sink which is provided on the single stem.

19. An optical scanning apparatus according to claim 9, wherein said plurality of light emitting portions different in emission wavelength are independently provided on a heat sink which is provided on the single stem.

20. A laser beam printer according to claim 13, wherein said plurality of light emitting portions different in emission wavelength are independently provided on a heat sink which is provided on the single stem.

21. A laser beam printer comprising:

light source means provided with a plurality of light emitting portions different in emission wavelength on a single stem;

a deflector for deflecting a plurality of beams from said light source means;

an optical system for converging said plurality of beams deflected by said deflector;

wavelength separation means for separating said plurality of beams from said optical system from each other; and a photosensitive drum to which said plurality of beams separated by said wavelength separation means are guided, wherein said plurality of beams separated by said wavelength separation means are guided to different positions on said photosensitive drum.

22. A laser beam printer according to claim 21, wherein said light source means is so arranged that the plurality of light emitting portions different in emission wavelength are disposed in a single cap.

23. A laser beam printer according to claim 21, wherein said light source means is so arranged that the plurality of light emitting portions different in emission wavelength are juxtaposed in a direction normal to a main scanning section.

24. A laser beam printer according to claim 21, wherein said wavelength separation means comprises a dichroic mirror.

25. A laser beam printer according to claim 21, wherein said plurality of light emitting portions different in emission wavelength are independently provided on a heat sink which is provided on the single stem.

26. A laser beam printer comprising:

light source means provided with a plurality of light emitting portions different in emission wavelength on a single stem;

a deflector for deflecting a plurality of beams from said light source means;

wavelength separation means for separating said plurality of beams from said light source means from each other; and a photosensitive drum to which said plurality of beams separated by said wavelength separation means are guided, wherein said plurality of beams separated by said wavelength separation means are guided to different positions on said photosensitive drum.

27. A laser beam printer according to claim 26, wherein said light source means is so arranged that the plurality of light emitting portions different in emission wavelength are disposed in a single cap.

28. A laser beam printer according to claim 26, wherein said light source means is so arranged that the plurality of light emitting portions different in emission wavelength are juxtaposed in a direction normal to a main scanning section.

29. A laser beam printer according to claim 26, wherein said wavelength separation means comprises a dichroic mirror.

30. A laser beam printer according to claim 26, wherein said plurality of light emitting portions different in emission wavelength are independently provided on a heat sink which is provided on the single stem.

31. A laser beam printer comprising:

first light source means provided with a plurality of light emitting portions different in emission wavelength on a single stem;

second light source means which is different from said first light source means, said second light source means being provided with a plurality of light emitting portions different in emission wavelength on a single stem;

a deflector for respectively deflecting a plurality of beams from said first light source means and a plurality of beams from said second light source means into a first direction and a second direction different from the first direction by different reflection surfaces thereof;

a first optical system for converging said plurality of beams deflected to the first direction by said deflector;

a second optical system for converging said plurality of beams deflected to the second direction by said deflector;

first wavelength separation means for separating said plurality of beams from said first optical system;

second wavelength separation means for separating said plurality of beams from said second optical system;

a first photosensitive member to which said plurality of beams separated by said first wavelength separation means are guided; and a second photosensitive member to which said plurality of beams separated by said second wavelength separation means are guided.

32. A laser beam printer according to claim 31, wherein each of said first and second light source means is so arranged that, for each of said first and second light source means, the plurality of light emitting portions different in emission wavelength are disposed in a single cap.

33. A laser beam printer according to claim 31, wherein each of said first and second light source means is so arranged that, for each of said first and second light source means, the plurality of light emitting portions different in emission wavelength are juxtaposed in a direction normal to a main scanning section.

34. A laser beam printer according to claim 31, wherein each of said first and second wavelength separation means comprises a dichroic mirror.

35. A laser beam printer according to claim 31, wherein, for each of said first and second light source means, said plurality of light emitting portions different in emission wavelength are independently provided on a heat sink which is provided on the single stem.

36. A laser beam printer comprising:

first light source means provided with a plurality of light emitting portions different in emission wavelength on a single stem;

second light source means which is different from said first light source means, said second light source means being provided with a plurality of light emitting portions different in emission wavelength on a single stem;

a deflector for deflecting a plurality of beams from said first light source means and a plurality of beams from said second light source means by different reflection surfaces thereof, respectively;

first wavelength separation means for separating said plurality of beams from said first light source means from each other;

second wavelength separation means for separating said plurality of beams from said second light source means from each other;

a first photosensitive member to which said plurality of beams separated by said first wavelength separation means are guided; and a second photosensitive member to which said plurality of beams separated by said second wavelength separation means are guided.

37. A laser beam printer according to claim 36, wherein each of said first and second light source means is so arranged that, for each of said first and second light source means, the plurality of light emitting portions different in emission wavelength are disposed in a single cap.

38. A laser beam printer according to claim 36, wherein each of said first and second light source means is so arranged that, for each of said first and second light source means, the plurality of light emitting portions different in emission wavelength are juxtaposed in a direction normal to a main scanning section.

39. A laser beam printer according to claim 36, wherein each of said first and second wavelength separation means comprises a dichroic mirror.

40. A laser beam printer according to claim 36, wherein, for each of said first and second light source means, said plurality of light emitting portions different in emission wavelength are independently provided on a heat sink which is provided on the single stem.

* * * * *